US007229073B2

(12) United States Patent
David

(10) Patent No.: US 7,229,073 B2
(45) Date of Patent: Jun. 12, 2007

(54) GAME BOARD AND GAME THEREOF

(76) Inventor: Yvan David, 4321, Girouard Ave., Montreal, Quebec (CA) H4A 3E5

( * ) Notice: Subject to any disclaimer, the term of this patent is extended or adjusted under 35 U.S.C. 154(b) by 26 days.

(21) Appl. No.: 11/116,274

(22) Filed: Apr. 28, 2005

(65) Prior Publication Data

US 2006/0244212 A1 Nov. 2, 2006

(51) Int. Cl.
*A63F 3/00* (2006.01)

(52) U.S. Cl. ..... 273/239; 273/285

(58) Field of Classification Search ..... 273/239, 273/285, 286

See application file for complete search history.

(56) References Cited

U.S. PATENT DOCUMENTS 3,210,080 A 10/1965 Rael et al.
6,464,507 B1 * 10/2002 Bailey ..... 434/247
2003/0034612 A1 * 2/2003 Yoon ..... 273/348.3

* cited by examiner

*Primary Examiner*—Vishu Mendiratta

(57) ABSTRACT

A game board for playing a game thereon using a magnet sensitive game piece. The game board includes a substantially flexible and substantially non-magnetic first sheet of material defining a first sheet first surface and a substantially opposed first sheet second surface. The substantially flexible and substantially permanently magnetized second sheet of material defines a second sheet first surface and a substantially opposed second sheet second surface. The first sheet second surface is secured to the second sheet first surface so as to substantially prevent a relative displacement therebetween. The game board is selectively rollable and unrollable respectively between the substantially cylindrical rolled configuration that is substantially flat unrolled configuration. When the game board is in the unrolled configuration, the first sheet first surface is usable as a playing surface for receiving the game piece thereon. The latter is releasably secured to the game board by the magnetic force generated by second sheet of material. When the game board is in the rolled configuration, the game board is relatively compact for facilitating transportation thereof.

4 Claims, 2 Drawing Sheets

GAME BOARD AND GAME THEREOF

FIELD OF THE INVENTION

The present invention relates to the general field of entertainment. More specifically, the present invention is concerned with a game board and game thereof.

BACKGROUND OF THE INVENTION

There exist many types of game boards. In addition to traditional cardboard boards, there exist metallic boards usable in conjunction with magnetic game pieces, such as tokens. The use of a magnetic board allows playing of a game in a relatively unstable environment, such as for example in a moving vehicle, or outdoors wherein wind may cause traditional game tokens to be unintentionally displaced.

However, there also exist situations wherein metallic boards and magnetized game pieces may not be conveniently used. For example, if the game includes cards, the use of magnetic cards would be relatively undesirable as the cards would then either be pushed apart from each other or be attracted to each other.

In such situations, a game board such as the game board described in U.S. patent application Ser. No. 3,210,080 issued Oct. 5, 1965 to Rael et al. is usable. In this game board, magnets are disposed between two outside panels. The magnets are supported inside recesses provided within a central base. The board described in this patent is foldable for storage and transportation.

However, since the board is only foldable along a single fold, the board is still relatively large even in a folded configuration. Additionally, in cases wherein the outside panels of the board are made of cardboard, the board is relatively sensitive to environmental damages, such as for example to rain. Since this type of board is sometimes intended for use outdoors, the sensitivity to environmental damage is a relatively major disadvantage.

Against this background, there exists a need in the industry to provide a novel game board and game thereof The present description refers to a number of documents, the content of which is herein incorporated by reference in their entirety.

OBJECTS OF THE INVENTION

An object of the present invention is therefore to provide an improved game board and game thereof.

SUMMARY OF THE INVENTION

In a first broad aspect, the invention provides a game board for playing a game thereon using a magnet sensitive game piece. The game board includes a substantially flexible and substantially non-magnetic first sheet of material defining a first sheet first surface and a substantially opposed first sheet second surface. A substantially flexible and substantially permanently magnetized second sheet of material defines a second sheet first surface and a substantially opposed second sheet second surface. The first sheet second surface is secured to the second sheet first surface so as to substantially prevent a relative displacement therebetween. The game board is selectively rollable and unrollable respectively between the substantially cylindrical rolled configuration that is substantially flat unrolled configuration. When the game board is in the unrolled configuration, the first sheet first surface is usable as a playing surface for receiving the game piece thereon. The latter is releasably secured to the game board by the magnetic force generated by second sheet of material. When the game board is in the rolled configuration, the game board is relatively compact for facilitating transportation thereof.

In this document, the term magnet sensitive is to be understood as relating to materials that contain ferrous materials and to any other materials that are magnetizable by a magnetic field produced by a magnet such that the material is attracted by the magnet.

Advantageously, the game board is rollable so as to provide a relatively compact and relatively easy to transport configuration. In addition, in some embodiments of the invention, the first sheet of material includes a fabric and the second sheet of material includes a polymer into which magnetic particles are dispersed. In this case, the game board is relatively waterproof.

The game board is relatively easy to manufacture, relatively inexpensive, and relatively easy to use. Furthermore, the game board is economic and does not necessitate the use of any specialized tool to be rolled and unrolled. Also, the game board is manufacturable in many suitable dimensions.

In another broad aspect, the invention provides a game comprising in combination a game board and a magnet sensitive game piece, the game piece including a substantially magnetizable portion.

Other objects, advantages and features of the present invention will become more apparent upon reading of the following non-restrictive description of preferred embodiments thereof, given by way of example only with reference to the accompanying drawings.

DETAILED DESCRIPTION

Figure 1:
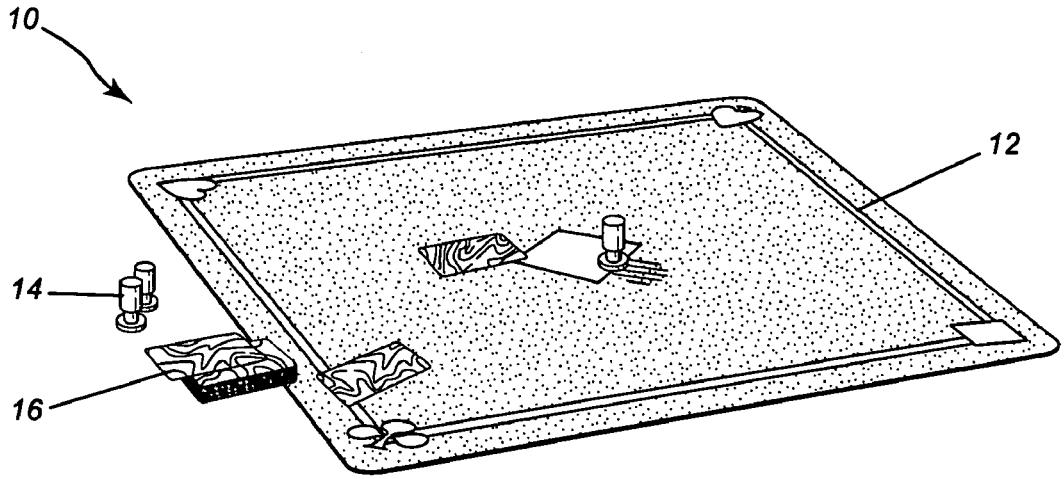
FIG. 1 illustrates in a perspective view a game according to the invention, the game including a game board and game pieces in the form of tokens and cards.

FIG. 1 illustrates a game 10. The game 10 includes a game board 12 and game pieces in the form of game tokens 14 and game cards 16. As better illustrated in FIG. 3, the game board includes a substantially flexible and substantially non-magnetic first sheet of material 18 defining a first sheet first surface 20 and a first sheet second surface 22 substantially opposed to the first sheet first surface 20. The game board 12 further includes a substantially flexible and substantially permanently magnetized second sheet of material 24 defining a second sheet first surface 26 and a substantially opposed second sheet second surface 28. The first sheet second surface 22 is secured to the second sheet first surface 24 so as to substantially prevent the relative displacement therebetween.

In some embodiments of the invention, the game board 12 further includes a substantially flexible and substantially non-magnetic third sheet of material 30 defining a third sheet first surface 32 and third sheet second surface 34. The third sheet first surface 32 is secured to the second sheet second surface 28 so as to substantially prevent a relative displacement therebetween. However, in alternative embodiments of the invention, the game board 12 does not include the third sheet of material 30.

The game pieces 14 and 16 each include a substantially magnetizable portion. A suitable example of a magnetizable portion includes, for example, a piece of a ferrous material that is attracted by an object producing a magnetic field. However, it is within the scope of the invention to have any suitable magnetizable portion in the game pieces 14 and 16.

Figure 2:
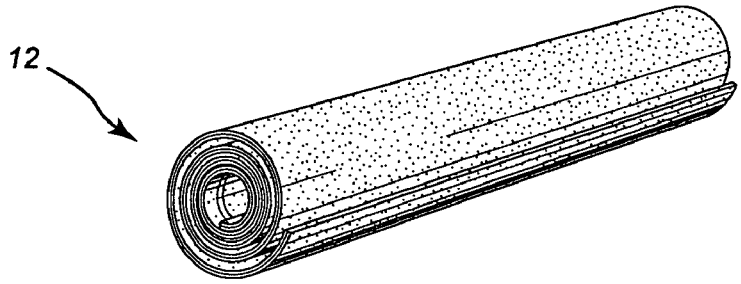
FIG. 2 illustrates in a perspective view the game board of FIG. 1 in a rolled configuration.

The game board 12 is selectively rollable and rollable respectively between the substantially cylindrical rolled configuration (shown in FIG. 2) and a substantially flat, unrolled configuration (shown in FIG. 1).

When the game board 12 is in the unrolled configuration, the first sheet first surface 20 is usable as a playing surface for receiving the game pieces 14 and 16 thereon. In this configuration, the game pieces 14 and 16 are releasably secured to the game board 12 by the magnetic force generated by the second sheet of material 24. When the game board is in the rolled configuration, the game board 12 is relatively compact for facilitating transportation and storage thereof.

In specific embodiments of the invention, the first and third sheet of materials 18 and 30 each include a fabric. An example of suitable fabric is felt. Another example of a suitable fabric is Nylon™. However, it is within the scope of the invention to have first and third sheet of materials 18 and 30 that include any alternative suitable material. The use of felt is relatively advantageous in some embodiments of the invention as this material is relatively waterproof in that it can be wet without becoming damaged.

In some embodiments of the invention, the first and third sheets of material 18 and 30 are of a thickness included within an interval of from about 0.7 mm to about 3 mm. However, it is within the scope of the invention to have first and third sheets of material 18 and 30 of any other suitable thickness The second sheet of material 30 is any suitable permanently magnetized sheet of material. For example, the second sheet of material 30 includes a substantially flexible polymer into which magnetized particles are dispersed. However, it is within the scope of the invention to include any suitable flexible and magnetized materials into the second sheet of material 24. Since such materials are well known in the art, this second sheet of material 24 is not described in further details herein. Also, the reader skilled in the art will readily appreciate how to select the second sheet of material so that a suitable attraction between the game board 12 and the game tokens 14 and cards 16 is produced.

In some embodiments of the invention, the second sheet of material 24 is of a thickness of from about included within an interval of from about 0.7 mm to about 3 mm. However, it is within the scope of the invention to have second sheets of materials 24 of any suitable thickness.

In some embodiments of the invention, a total thickness of the game board 12 is included within the interval of from about 3 mm to about 6 mm, with the second sheet of material 24 having a thickness of from about 1.5% to about 60% of the total thickness of the game board 12. While these values have been found to be suitable to some applications, in other embodiments of the invention the total thickness of the game board 12 and the fraction of this thickness represented by the second sheet of material 24 take any other suitable values.

The first and third sheets of materials 18 and 30 are secured to the second sheet of material 24 in any suitable manner, for example with glue or an adhesive tape. However, it is within the scope of the invention to use other suitable methods for securing the first and third sheets of material 18 and 30 to the second sheet of material 24.

As shown in FIG. 1, in some embodiments of the invention, markings 36 are provided onto the first sheet first surface 20. The markings 36 are either decorative markings or, alternatively, markings related to the game playable with the game board 12. In some embodiments of the invention, the third sheet second surface 34 also bears markings related to a game to play. In these embodiments, it is therefore possible to play at least two different games using the board 12.

Markings are printed, embossed, engraved or marked in any suitable manner onto the first and third sheets of materials 18 and 30. For example, and non-limitatively, in some embodiments of the invention the markings are printed using a silk screen printing process.

Figure 3:
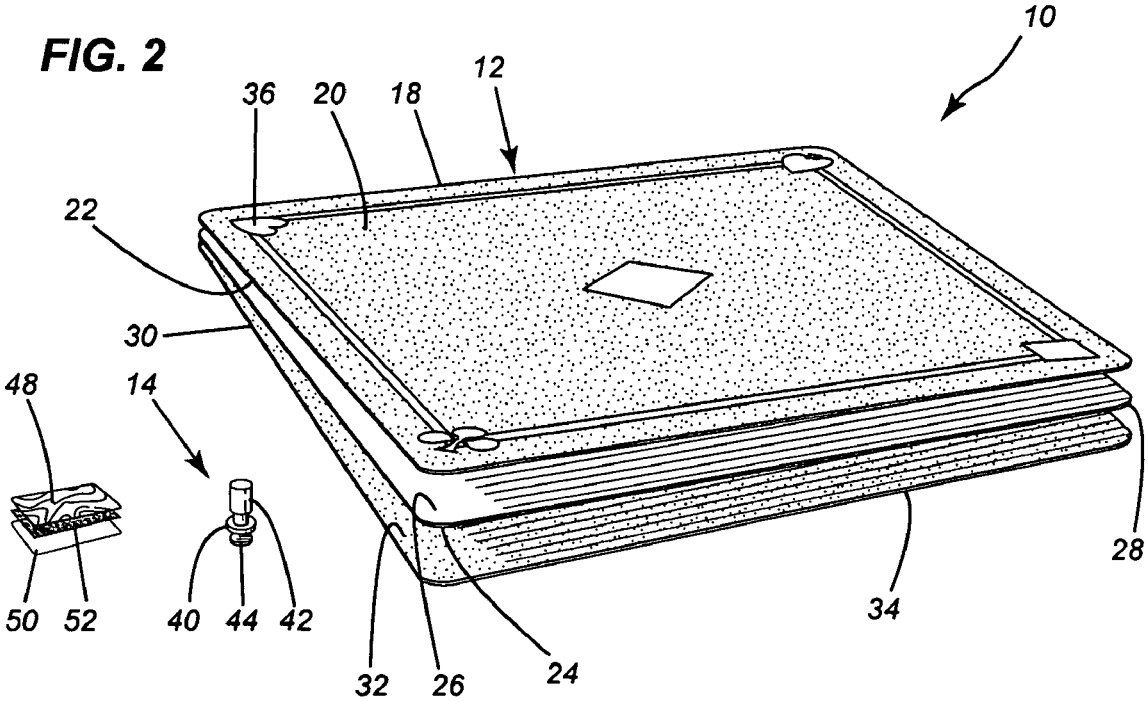
FIG. 3 is a perspective exploded view of the game of FIG. 1.

The game token 14 is any suitable game token. For example, the game token 14 includes a base 40 and a head 42 extending from the base 40. As shown in FIG. 3, the base 40 receives therein a magnetic portion 44 in the form of a piece of a ferrous material. Such tokens are well known in the art and the reader skilled in the art will readily appreciate that any suitable token is usable in conjunction with the invention.

The game cards 16 include any suitable cards. For example, such a game card is described in above-cited U.S. patent application Ser. No. 3,210,080. Alternatively, a game card 16 illustrated in FIGS. 1 and 3 is used. The game card 16 includes first and second substantially opposed and substantially non-magnetic card sheets 48 and 50 that are secured to each other, for example using glue or any other suitable securing method. The magnetizable portion includes a metallic powder 52 provided between the first and second card sheets 48 and 50.

The first and second card sheets 48 and 50 include any suitable material, for example either one or both of paper and cardboard. In some embodiments of the invention, the first and second card sheets 48 and 50 are at least in part plastic-coated so as to improve their weatherproofing. However, it is within the scope of the invention to have card sheets 48 and 50 that are not plastic coated.

In use, the game board 12 is unrolled from the rolled configuration into the unrolled configuration. Then, the game board 12 is usable to play the game. When the game is finished, or when there is a need to either store or transport the game board 12, the game pieces 14 and 16 are removed from the game board 12 and the game board is rolled into the rolled configuration.

Figure 4:
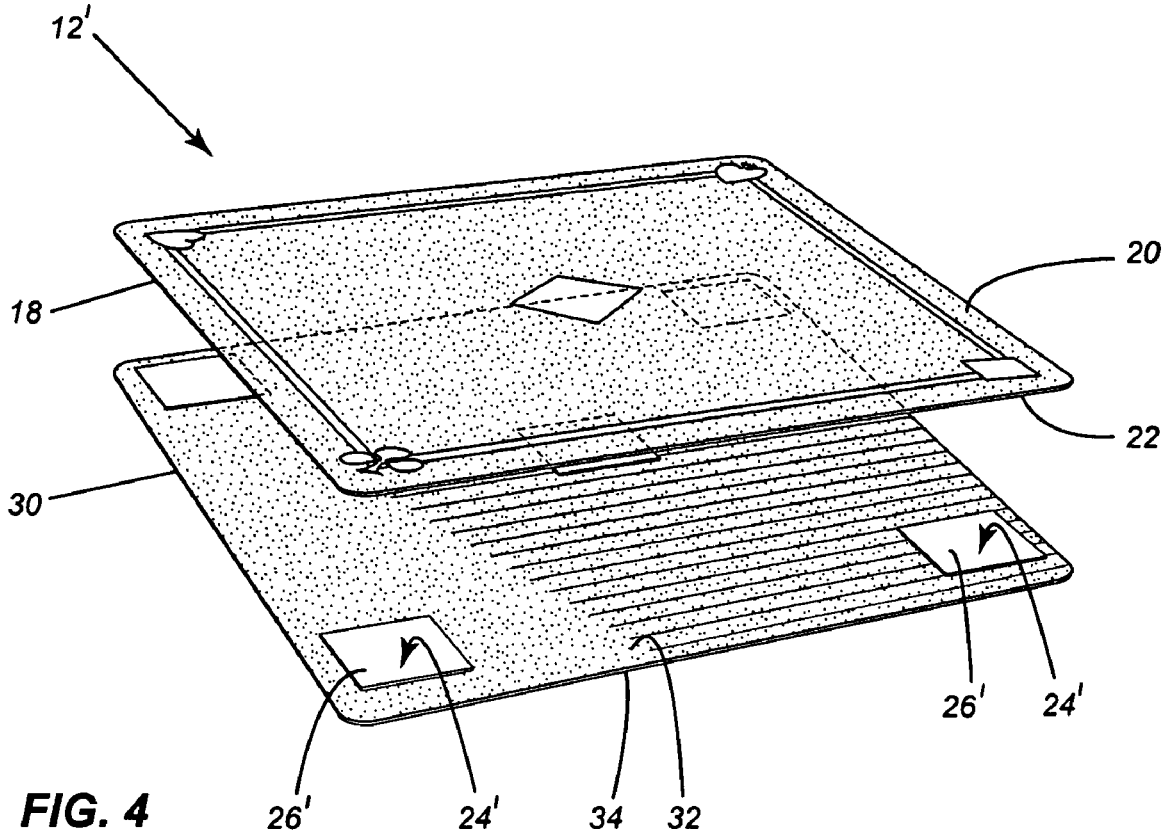
FIG. 4 illustrates an alternative embodiment of a game board.

FIG. 4 illustrates an alternative game board 12'. The game board 12' is similar to the game board 12 except that it includes a plurality of substantially flexible and substantially permanently magnetized sheets of material 24' in placement to the second sheet of material 24. Each of the permanently magnetized sheets of materials defines a respective magnetized sheet first surface 26 and respectively substantially opposed magnetized sheet second surface (not shown in FIG. 4).

The magnetized sheet first surface 26' of each of the magnetized sheets 24' is secured to the first sheet second surface 22 so as to prevent a relative displacement therebetween. Also, the magnetized sheet second surfaces of each of the magnetized sheets 24' are secured to the third sheet first surface 32 so as to substantially prevent the relative displacement therebetween. Therefore, the role of the magnetized sheets 24' substantially similar to the role of the second sheet of material 24, except that game board 12 is not magnetized over substantially its entire surface.

An example of a situation wherein this is desirable includes a situation wherein the game board 12' is relatively large so as to allow many players to play a game. If the game does not require that tokens or cards be placed everywhere onto the board, the use of the magnetized sheets 24' may reduce the costs associated with manufacturing the game board 12'.

Figure 5:
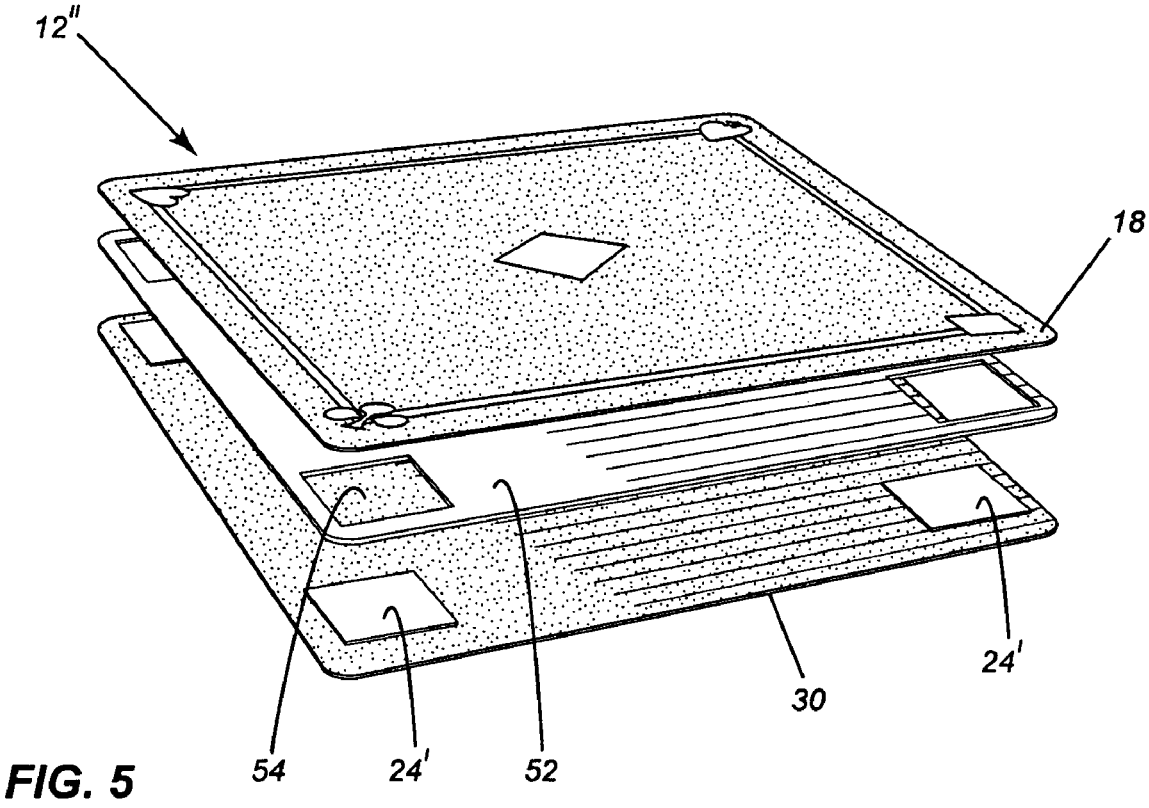
FIG. 5 illustrates another alternative embodiment of a game board.

FIG. 5 illustrates yet another game board 12" that is relatively similar to the game board 12'. However, the game board 12" further includes a substantially flexible and substantially non-magnetic base sheet 52. The base sheet 52 defines apertures 54 extending therethrough that are of shapes substantially similar to the shape of the magnetized sheets 24'. The base sheet is secured to the first and third sheets of material substantially similarly to the second sheet of material 24. Therefore, the base sheet 52 allows having a game board that is not magnetized over substantially its entire surface but is nevertheless of a substantially uniform thickness.

In alternative embodiments of the invention, the base sheet 52 includes a substantially magnetizable material. In these cases, a magnetic field created by the magnetized sheets 24' is distributed by the base sheet 52 so as to produce a game board that is substantially magnetized over at least a portion of its surface larger than the portion occupied the magnetized sheets 24'.

Although the present invention has been described hereinabove by way of preferred embodiments thereof, it can be modified, without departing from the spirit and nature of the subject invention as defined in the appended claims.

What is claimed is:

1. A game, comprising in combination:

a game board including a first sheet of material, said first sheet of material being substantially flexible and substantially non-magnetic;

a magnetized layer, said magnetized layer including at least two magnetized sheets of material, said at least two magnetized sheets of material laterally spaced apart, each of said magnetized sheets of material being substantially flexible and substantially permanently magnetized; and a second sheet of material, said second sheet of material being substantially flexible and substantially non-magnetic;

said first and second sheets of material being in a substantially parallel and substantially in register relationship relative to each other, said magnetized sheets of material being substantially disjoint from each other and located between said first and second sheets of material, said magnetized sheets of material being secured to said first and second sheets of material so as to substantially prevent a relative displacement between each of said magnetized sheets of material and said first and second sheets of material, and a card set including a plurality of cards, each of said cards being substantially non-magnetic and including a magnetically responsive portion;

wherein said game board is selectively rollable and unrollable between a substantially cylindrical rolled configuration and a substantially flat unrolled configuration;

whereby when said game board is in said unrolled configuration said first sheet of material is usable as a playing surface for recieving said cards thereon while said cards are releasably secured to said game board by the magnetic force generated by said magnetized sheets of material, and, when said game board is in said rolled configuration said game board is relatively compact for facilitating transportation thereof.

2. A game as claimed in claim 1, further comprising a substantially flexible base sheet, said base sheet being positioned between said first and second sheets of materials, said base sheet defining at least two apertures extending therethrough, each of said apertures receiving thereinto a respective one of said magnetized sheets of materials;

wherein said base sheet is secured to said first and second sheets of material so as to substantially prevent a relative displacement therebetween.

3. A game as defined in claim 2, wherein said base sheet is substantially non-magnetic.

4. A game as defined in claim 3, wherein said base sheet includes a substantially magnetizable material.

* * * * *